United States Patent [19]

Sarrazin et al.

[11] Patent Number: 4,695,498

[45] Date of Patent: Sep. 22, 1987

[54] PAPERMAKERS FLAT WOVEN FABRIC

[75] Inventors: Yvon Sarrazin, Valleyfield, Canada; Harry D. Smolens, Norristown, Pa.

[73] Assignee: Asten Group, Inc., Charleston, S.C.

[21] Appl. No.: 678,987

[22] Filed: Dec. 5, 1984

Related U.S. Application Data

[62] Division of Ser. No. 399,992, Jul. 20, 1982, abandoned.

[51] Int. Cl.[4] ..... B32B 3/04

[52] U.S. Cl. ..... 428/121; 139/383 A; 162/DIG. 1; 162/358; 428/193; 428/221; 428/222; 428/223; 428/224; 428/225; 428/257

[58] Field of Search ..... 428/33, 102, 121, 193, 428/221, 222, 223, 224, 225, 257; 162/DIG. 1, 358; 139/383 A

[56] References Cited

U.S. PATENT DOCUMENTS

| | | | |
|---|---|---|---|
| 2,883,734 | 4/1959 | Draper, Jr. | 28/141 X |
| 3,474,507 | 10/1969 | Thompson | 24/265 |
| 4,250,822 | 2/1981 | Fickers | 112/262.1 |
| 4,315,049 | 2/1982 | Fickers | 428/104 |
| 4,401,137 | 8/1983 | Cannon | 139/383 |

FOREIGN PATENT DOCUMENTS

| | | | |
|---|---|---|---|
| 1425987 | 12/1965 | France . | |
| 48-15715 | 5/1973 | Japan | 28/141 |
| 1266891 | 3/1972 | United Kingdom | 28/141 |
| 2090788 | 7/1982 | United Kingdom . | |
| 2102730 | 2/1983 | United Kingdom . | |

*Primary Examiner*—James J. Bell

*Attorney, Agent, or Firm*—Benasutti and Murray

[57] ABSTRACT

The present invention is directed to a low bulk pin-type seam for use with the flat woven fabric. The preferred fabric is woven with continuous or monofilament yarns in the machine direction. The seam is formed by interconnecting loops constructed from the machine direction warp yarns. In constructing the seam loops, a portion of the fabric is made free of cross machine direction yarns and the warp yarns are selected out as either a loop forming yarn or as binder yarns. The fabric is then folded back upon itself in hem like fashion with the selected yarns being retained as loop forming yarns and the binder yarns being drawn back through the hem portion of the fabric to bind the hem and body portion of the fabric. If desired, a stitch pattern may be added to further secure the hem area.

3 Claims, 9 Drawing Figures

PAPERMAKERS FLAT WOVEN FABRIC

This is a divisional of application Ser. No. 399,992, filed July 20, 1982, now abandoned.

BACKGROUND OF THE INVENTION

1. Field of the Invention

The present invention relates to the field of low bulk seams for use with papermakers machine fabrics, and more particularly relates to such a seam for use in monofilament fabrics.

2. Prior Art

The prior art has for some time, recognized that papermakers fabrics may be flat woven and then seamed in order to produce an endless fabric on the papermaking machinery. The earliest attempts to form seamed fabrics utilized a technique of back weaving the flat woven fabric ends to produce essentially an endless belt. This technique was both time consuming and difficult. It was later recognized that flat woven fabrics could be made into an endless belt by use of hooks or loops which were affixed to the respective ends of the flat woven fabrics and then made to interleaf with each other so as to form a channel wherein a pintle hook or joining wire could be inserted. Other recent attempts to join flat woven fabrics to an endless belt have utilized a coil which was affixed to the respective ends of the flat woven fabric and interleafed to form a channel for receiving a pintle or joining wire. In recent years, some monofil fabrics have been seamed by a technique of selecting alternate warp ends which are formed into a loop and then back woven into the fabric so as to retain the end in the fabric. Once again, the loops so formed were interleased to form a channel for receiving a pintle wire or joining wire.

As noted, one prior art attempt at making pin seams in papermakers felt has been to utilize alternating warp ends which are formed into a loop at the ends of the fabrics that are woven back to the body of the fabric. The loops formed on either end of the fabric at the ends thereof are made complementary and mate with each other so that a long wire or pintle may be inserted through the channel formed by the loops to join the two ends of the fabric into an endless fabric belt. The seam thus formed is not substantially thicker than the normal thickness. However, the process of weaving the warp ends back into the fabric in order to form the loops and the associated fabric weakness have lead to reduced wear characteristics for pin seams formed by this back weaving method.

Also as noted, a second prior art attempt used various coil type seams wherein coils or spirals are inserted along a fold line and the fabric is folded back over itself or otherwise attached to itself so that the coil may matably receive a coil similarly attached to the other end of the fabric. A wire or pintle is then used to join the seam as mentioned previously. While coil seams have achieved some success, the additional thickness and thickness irregularity attended with such seams has limited their applicability, their life, and/or the reliability thereof.

To date, the prior art attempts to produce a pin type seam in a monofilament fabric have resulted in a high fabric bulk adjacent to the pin seam area and undesirable running characteristics for the belt as a result of the seam. It has long been recognized that the seam area of the flat woven fabric which has been joined to make an endless belt is a major contributor to product defects and fabric failure.

SUMMARY OF THE INVENTION

The present invention is directed to a fabric having a low bulk pin-type seam. The seam is constructed by forming loops in each end of a flat woven papermakers fabric. The loops are formed from machine direction yarns which are selected from a portion of the fabric which had previously been freed of all cross machine direction yarns. The fabric is folded back on itself in the manner of a hem and selected machine direction yarns are pulled through the fabric to bind the fabric body and fold over together. Both ends of the fabric are made similar and when mated together, the loops forming yarns define a channel which receives the pin or pintle wire.

DETAILED DESCRIPTION OF THE PREFERRED EMBODIMENT

Although specific forms of the invention have been selected for illustration and the following description will refer in specific terms to those drawings, this description is not intended to limit the scope of the invention which is defined in the claims appended hereto.

The invention will be set forth with references to the attached drawings, wherein like numerals indicate like elements in all views. The following description is intended to aid in an understanding of the invention and it is understood that the invention may be utilized with weaves or fabrics not specifically described in detail.

Figure 1:
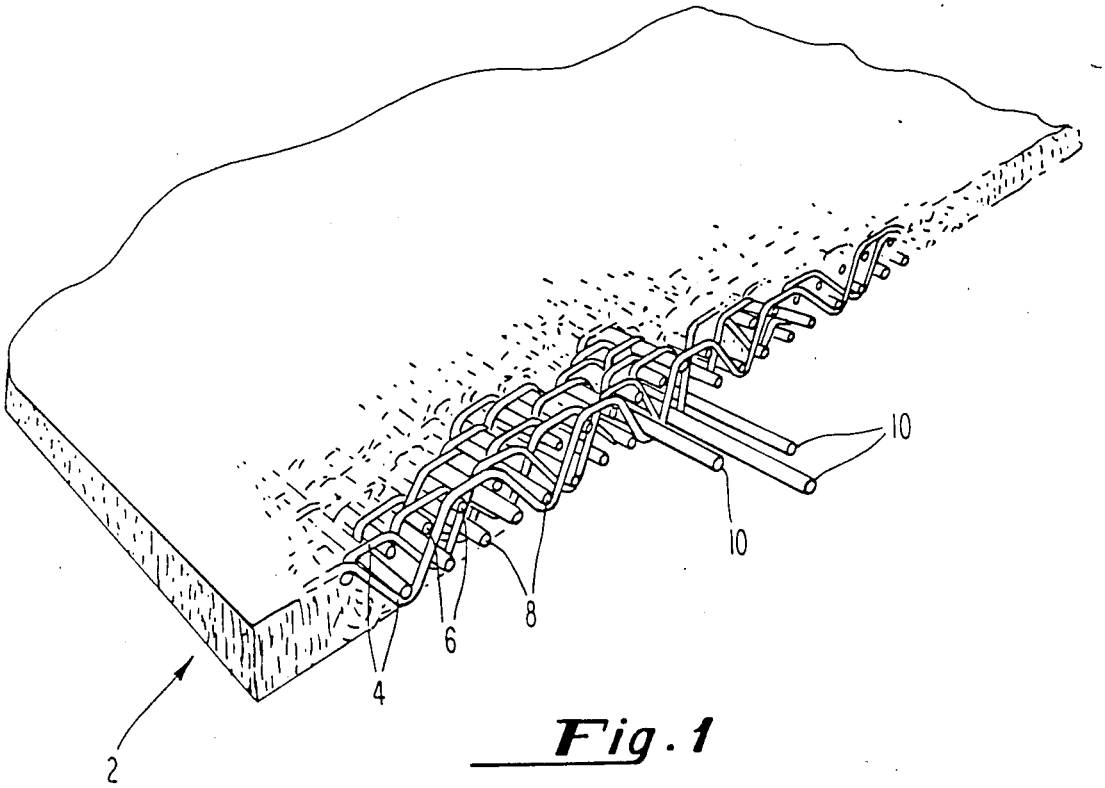
FIG. 1 is an orthographic projection of a fragment of a fabric end to be seamed in accordance with the invention.

Referring now to FIG. 1, there is shown a fragmentary view of one end of the fabric 2 which is to be seamed. The fabric 2 is woven in the usual manner with a plurality of warp yarns or machine direction yarns interlacing with a plurality of pick or cross machine direction yarns 6 and 8. The warp yarns are preferably monofilament or continuous filament yarns, however, they may be spun yarns which are twisted or treated so as to behave as continuous or monofilament yarns. Additionally, it will be understood that the warp yarns may be of any cross sectional shape, i.e. round, square, oval, rectangular, etc., according to fabric design. Likewise, the pick yarns may be any of the available yarns selected according to fabric design. As will be known to those skilled in the art, the fragmentary view of the fabric 2 shown in FIG. 1 is a duplex fabric having two pick systems, comprised of yarns 6 in one pick system and yarns 8 in the other pick system, interwoven with a single warp or machine direction system 4. As will also be known to those skilled in the art, the overall length of the fabric prior to seaming is somewhat longer than the length of the final seamed fabric in order to provide the material necessary for fabric seaming and subsequent treatment. While the fabric 2 may be cut to the predetermined width of the desired fabric, it has been found that it is advantageous to have approximately 2 inches of additional width in the unseamed fabric in order to facilitate the ease of seaming.

Generally, the fabric end is prepared for seaming by removing a plurality of picks 6 and 8 from a predetermined area of the fabric. The warp yarns which have been exposed by the removal of the picks are then segregated into loop forming yarns and binder yarns according to a predetermined pattern. A loop forming wire is inserted between the warp yarns which will essentially separate the fabric into 2 levels. The forming wire is located as close to the body of the fabric is as possible. The fabric is then placed on a work table with the fabric faced down. The free end of the fabric is then folded back toward the body of the fabric in the manner of a hem. The folding back of the free end of the fabric thus produces a plurality of loops extending from the fabric fold or hem line. The binder warp ends noted previously are then drawn back into the folded over section of the fabric. After the binder yarns have been pulled back into the fold over of the fabric, the fold over section of the fabric is cut to width. Stitches are then placed in the seam area to additionally secure the fold over and fabric together. The fold over is then trimmed or cut to length and beveled or rounded as is known in the art.

Figure 2:
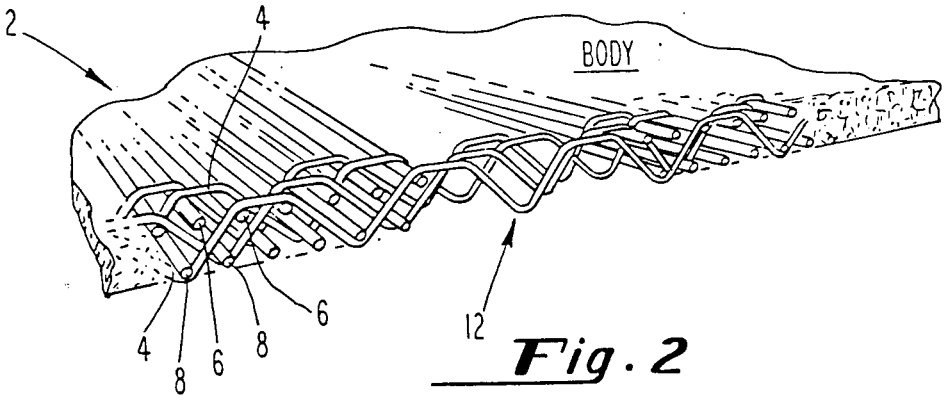
FIG. 2 is an orthographgic projection of the fabric of FIG. 1 with a pick free area.

With reference to FIG. 1, the preparation of one end of the fabric seam will be described in detail. It will be remembered that the other end of the fabric is prepared in a like manner. Selected picks are removed at an area in from the free end of the fabric in order to provide sufficient material for the fold over section. In the preferred embodiment, the pick removal area is approximately five inches from the free end of the fabric. The picks to be removed, generally illustrated as 10 are removed in both the face and back pick layers. Picks 10 are removed from the fabric for approximately (three-eights) of an inch starting from the end of the fold area previously described. Thus, picks are removed in the area between approximately five to five and three eights (5–5⅜) inches from the free end of the fabric, this pick free condition is illustrated in FIG. 2 and generally identified as 12.

Figure 3:
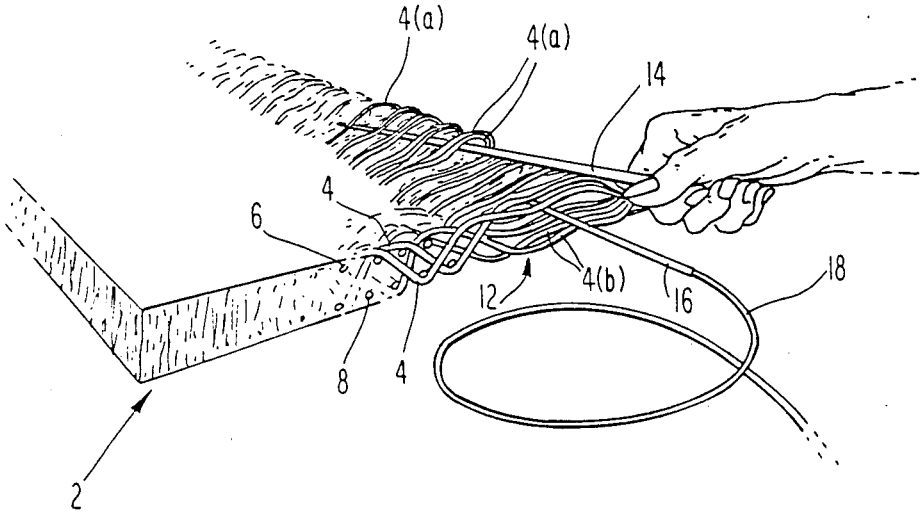
FIG. 3 illustrates the separation of warp yarns according to the invention.

Referring now to FIG. 3, a tool 14 such as a long stem awl or scriber, is used to separate pairs of the warp yarns 4. Alternating pairs of warp yarns 4(*a*) are raised from the plane of the fabric using the tool 14, likewise, alternating pairs of warp yarns 4(*b*) are left within the plane of the fabric, as illustrated in FIG. 3. The operation of raising the warp yarns 4(*a*) out of the plane of the fabric is difficult to illustrate, however, this will be known to those skilled in the art. As shown in FIG. 3, after a number of the warp yarns 4(*a*) have been raised from the plane of the fabric, a suitable needle or insertion tool 16 with a forming wire 18 attached is inserted between the raised warp yarns 4(*a*) and the remaining warp yarns 4(*b*). Note that since the warp yarns 4(*b*) have not been disturbed with respect to the plane of the fabric, the forming wire when inserted will overlie the warp yarns 4(*b*). This condition is illustrated graphically in FIG. 4. The forming wire 18 is positioned as close to the body of the fabric as is reasonably possible. In this position the forming wire 18 will be adjacent the fold line or hem line 19 as will be described hereinafter. Warp yarns 4(*a*) will be binder yarns and warp yarns 4(*b*) will be loop forming yarns.

After the fabric has been so prepared, the fabric is positioned on a work table with the fabric face down. Due to the bulk and weight of the flat woven fabric, it has been found advantageous to secure the fabric to the work table such as by tacking or other securing means. With the fabric so positioned, the free end of the fabric is then folded back over the body of the fabric. Once again, it has been found that securing the free end by tacking or other means is advantageous.

Figure 5:
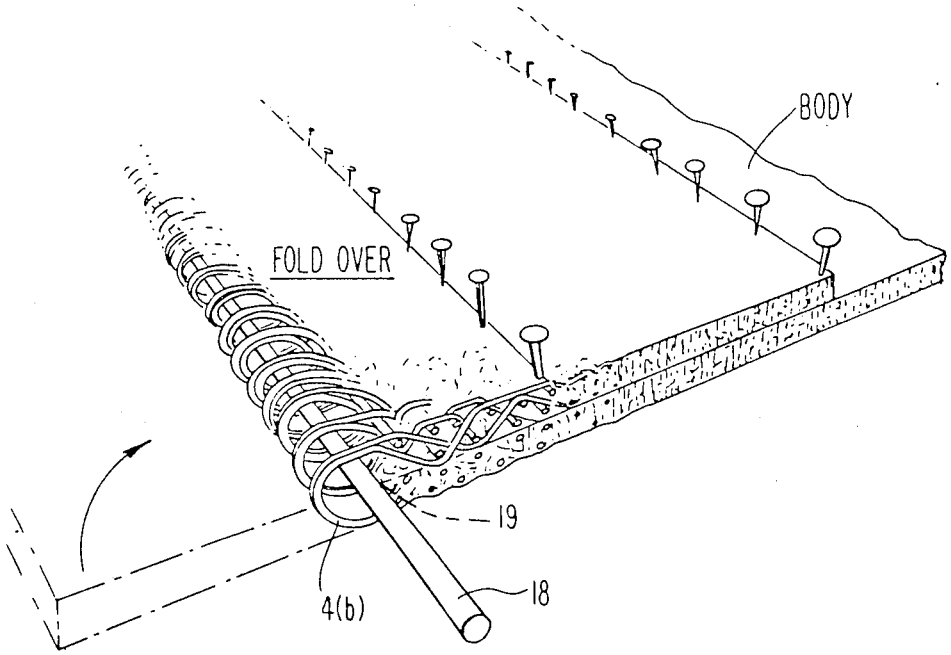
FIG. 5 illustrates the formation of a fold over or hem according to the invention.

With reference now to FIG. 5, there is shown the fabric (without the work table) in the folded or hemmed condition just described. For purposes of clarity of illustration, the fabric has been shown with only the loop forming warp yarns 4(*b*) extending from the hem line 19 adjacent the forming wire 18. It will be understood that the warp yarns 4(*a*) are still part of the fabric but they are not part of the loop forming warps shown in FIG. 5. Also it should be rememebered that warp yarns 4(*a*) are to become the binding yarns which are tight against the fold or hem line and therefore would not appear in the area of the loops in the final configuration.

Figure 6:
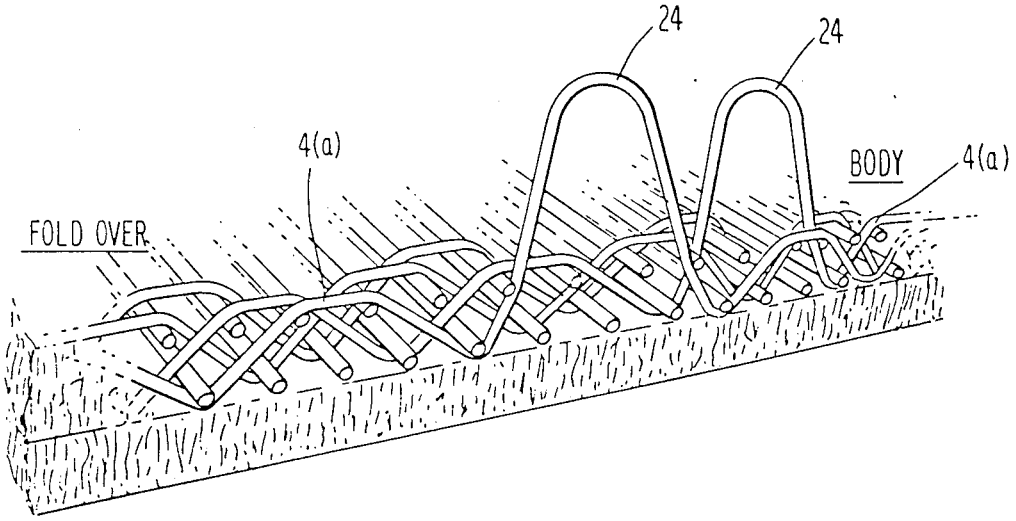
FIG. 6 illustrates the pull through of selected warp yarns against the hem line according to the invention.
Figure 7:
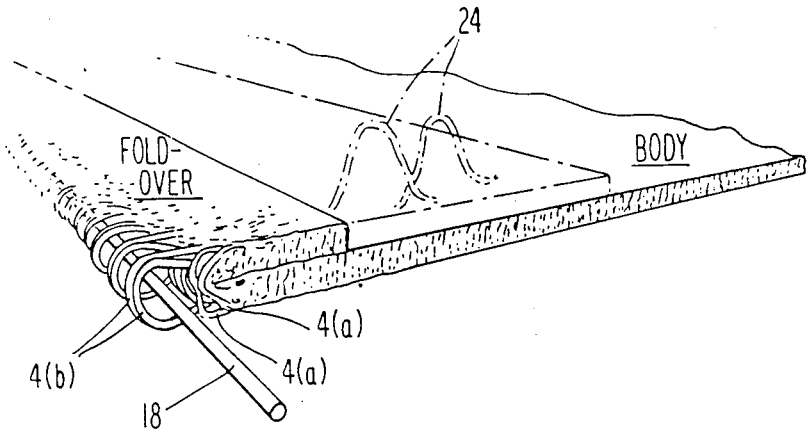
FIG. 7 illustrates the fabric seam end after pull through of the selected yarns and trimming of the hem.

After the fabric has been secured to a work surface and has been folded as indicated in FIG. 5, the binder warp yarns 4(*a*), which are not part of the loop, are pulled through the fabric. With reference to FIG. 6, it can be seen that the warp yarns 4(*a*) can be pulled through the folded over portion or hem of the fabric. For purpose of clarity, the yarns 4(*a*) are shown as the first yarns in the fabric, however, it will be understood that the yarns 4(*a*) are spaced across fabric at selected locations. The pulling of the warp yarns 4(*a*) through the fold of the fabric will serve to remove the excess warp length of yarns 4(*a*) in the area of the loop formed by the yarns 4(*b*). In pulling the warp yarns 4(*a*) through the fold over or hem it has been found beneficial to locate the outermost warp yarn and to begin pulling the slack out of the yarn created by the fold over. The pull through then proceeds across the width of the fabric until all of the binding yarns have had the slacks removed therefrom. While it is not necessary, it has on occassion been found beneficial to spray the warp yarns to be pulled through with a silicone lubricant. However, in using a silicon lubricant, care should be exercised because an excess application of silicone lubricant has also been found to create a sticky or tacky surface on the yarns which may actually hinder the pull through. The binder yarns 4(*a*) are pulled through the fold over with sufficient force to draw the fold over and body of the fabric into intimate contact. It has been found in constructing the seam that the appearance of a ripple may be noted in the fabric fold over or hem on the back of the seam. This ripple phenomenon has not been found to be detrimental to the seam and in fact, it has been found to be a useful indicator that the warp yarns have been pulled with sufficient force against the fold or hem line. Thus, the ripple may be used as an indicator that the pull through has been done correctly. The ripple is not always visible but can be felt with slight hand pressure or the finger tips. The pull through of the binder yarns 4(*a*) which has just been described should be completed so that the loops 24 of slack warp yarns are spaced approximately 2 inches from the position where the loop yarns 4(*b*) enter the fold over. By so spacing the loops 24, it is then possible to trim the fold over so that it may be trimmed or cut at 26 approximately one inch from the point where the loop yarns enter the fold over, see FIG. 7. As it will be recognized by those skilled in the art, the cut edge 26 of the fold over is preferably beveled, see FIG. 8, to aide in the running of the fabric on the papermaking machine.

Figure 8:
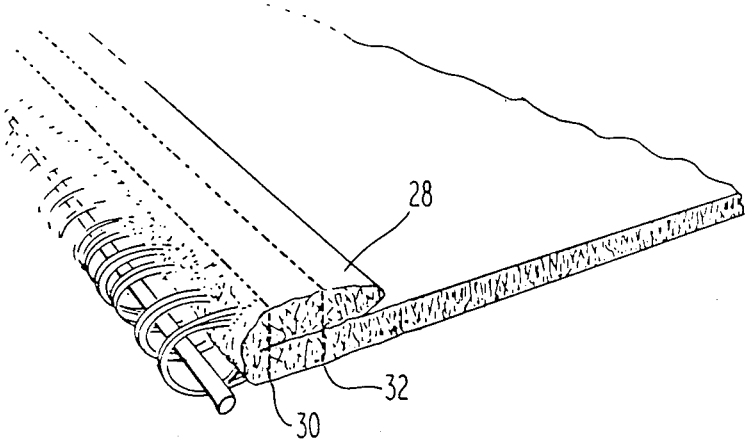
FIG. 8 illustrates the fabric of FIG. 7 with beveled edges and stitches according to the invention.

In some applications, it may be possible to use the seam without additional reinforcement, however, it is preferred that the fold over and fabric body be stitched together in the area adjacent the loops. With reference to FIG. 8, in the preferred embodiment two rows of stitching 30 and 32 are utilized. The first row of stitching 30 is located approximately 3/16 of an inch from the point where the loops 4(*b*) enter the fabric and a second row of stitching 32 is placed approximately $\frac{5}{8}$ of an inch from the first stitch. In applications where a smooth seam surface is essential, it has been found to be beneficial to remove a face pick in the position where the stitching 30 and 32 is to be located. If desired, the pick may be removed both from the body of the fabric and the fold over of the fabric. In this way, the stitching 30 and 32 will sink into the fabric and do not altar the surface characteristics thereof. In addition, to preserving the surface characteristics of the fabric, it is believed that the recessed stitching will not be subjected to excessive wear.

It will be understood by those skilled in the art that the selection of stitch point location will be a matter of design choice and will vary accordingly. For example, in a weave pattern such as shown in FIG. 1, one stitch arrangement which has been employed is to place the stitches at the fourth and thirteenth pick of one and at the fourteenth and ninth pick of the other end. Once again the fabric design is free to selected stitch points according to weave design.

Figure 4:
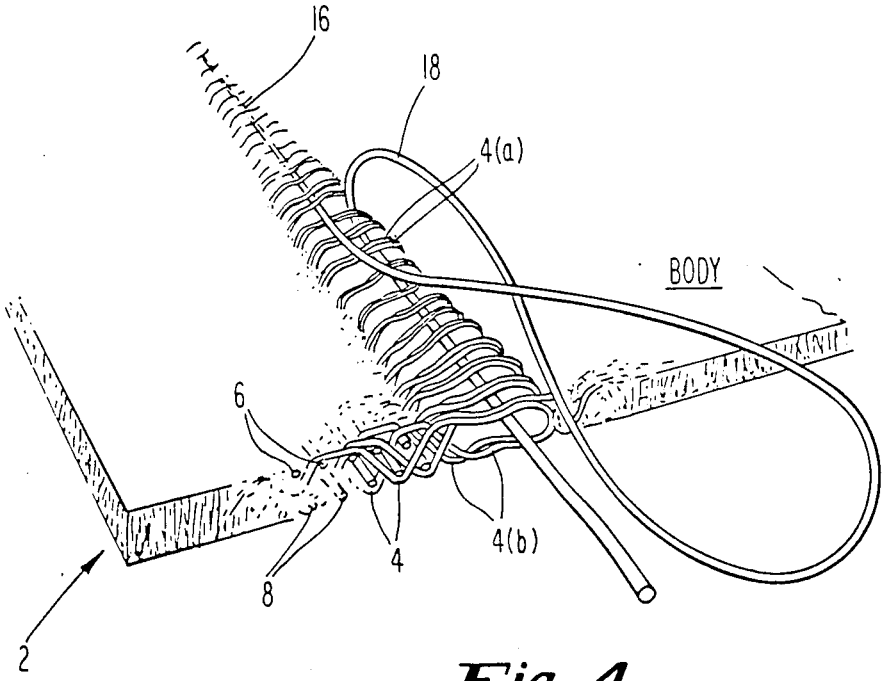
FIG. 4 illustrates the insertion of a loop forming means according to the invention.
Figure 9:
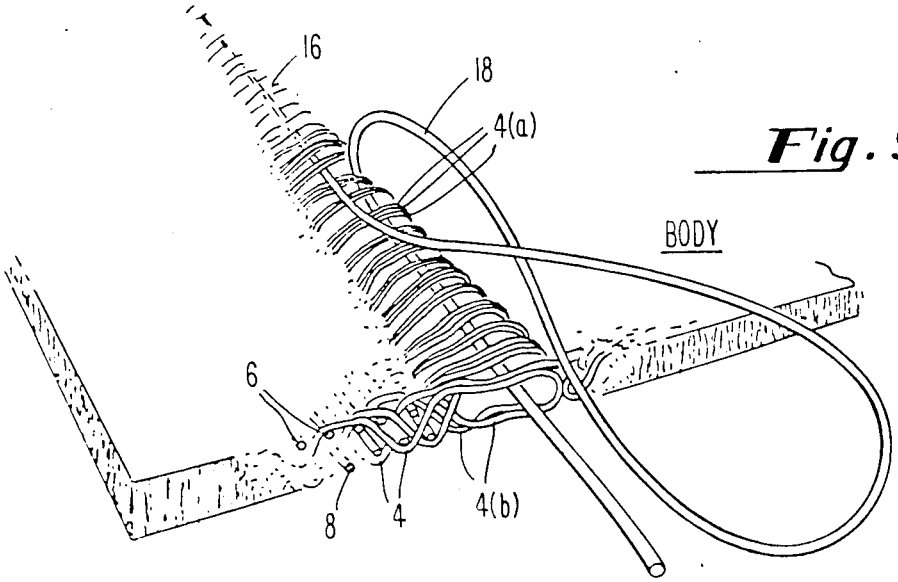
FIG. 9 illustrates an alternative embodiment according to the invention.

With respect to FIG. 9, there is illustrated an alternative embodiment which in all respects not set fourth hereinafter will be the same as the fabric illustrated in FIG. 4. In FIG. 4, the forming wire 18 is positioned such that the warps are paired into alternating loop and binder yarns. At FIG. 9, the forming wire 18 is positioned such that the warp yarns are arranged according to the selected repeat pattern. In this repeat pattern, the warp yarns are arranged as two binder, two loop, three binder and one loop yarn per repeat. This repeat pattern provides approximately 25% more binder yarns per seam with and approximately 25% less loop forming yarns per seam with. This alternative arrangement has been found to produce a seam which is fully acceptable with respect to strength and performance and which provides additional spacing between the loop forming yarns. The additional spacing between the loop forming yarns has found to be of some benefit in minipulating and aligning the loops in the actual seam formation process.

It will be recognized that many various repeat patterns will be possible with the instant invention. The essential feature is that the repeat pattern selected provide sufficient loop forming yarns to achieve the necessary tensile strength and maintain the seam stability. Likewise, it is required that sufficient binder yarns be provided to maintain the hem tightly and to assure the requried tensile strength.

Seams according to the invention have been made in both single ply and multiply fabrics and could be installed in fabrics ranging from a 20×20 texture single ply fabric to a 72×30 texture multiply fabric. As noted previously, the fabric weave construction may be according to design selection.

It will be understood that the other or remaining end of the flat woven belt will be prepared in the manner described above and that after such preparation, the two ends may be mated so that the loops are interleafed and thereby define a channel through which a hinge wire or pintle may be inserted to complete the pin seam.

It will be understood that no back weaving is required to form the loop and that no additional clipper hooks or coils are in the insert seam.

What we claim is:

1. An improved papermakers fabric comprising:

a flat woven fabric having at least one system of continuous machine direction monofilament yarns;

each end of said fabric having a portion of said fabric material folded back upon the adjacent portion of the fabric body thereby defining a hem and hem line;

said hem including an area having loop segments of selected machine direction yarns, extending therefrom;

a first group of machine direction yarn segments distributed in the cross machine direction being drawn against said hem line; and a second group of machine direction yarn segments interspersed among the yarn segments of the first group extending from said hem line in a defined series of loops such that the loops of the respective ends will intermesh to define a seaming channel which receives a pintle means and the yarns of said first and of said second groups are continuous throughout said fabric hem and body portions.

2. An improved papermaker's fabric of the type of which is flat woven and seamed by pintle means to form an endless papermaker's fabric, the improvement characterized by seaming loop areas which are comprised entirely of continuous monofilament machine direction yarns, the improvement comprising:

a flat woven fabric having at least one system of continuous monofilament machine direction yarns and at least one system of cross machine direction yarns interwoven therewith;

each end of said flat woven fabric having a portion thereof folded back upon itself to define fabric hem and body portions;

each hem including a first group of said continuous monofilament machine direction yarns, distributed in the cross machine direction, drawn against said hem and a second group of said continuous monofilament machine direction yarns, interspersed among the yarns of the first group, with a continuous segment thereof extending between said fabric body and hem portions, said second group being approximately equal in number to one-half of the total number of said continuous monofilament machine direction yarns; and each extending segment forming a continuous loop projecting from said fabric and body portions such that the loops of the respective ends will intermesh to define a seaming channel which receives the pintle means and the yarns of said first and second groups are continuous throughout said fabric hem and body portions.

3. An improved flat woven and seamed papermakers fabric which is joined by pintle means to form an endless papermakers fabric, the improvement comprising:

a flat woven fabric having at least one system of continuous monofilament machine direction yarns and at least one system of cross machine direction yarns interwoven therewith;

each end of said flat woven fabric having a portion thereof folded back upon itself to define a hem;

each hem including a first group of said continuous machine direction yarns distributed in the cross machine direction and drawn against said hem and a second group of said continuous machine direction yarn interspersed among the yarns of the first group with a segment thereof extending from said respective folded portions to the remainder of said fabric, said extending segments being approximately equal in number to one half of the total number of said continuous machine direction yarns; and each extending segment forming a loop projecting from said respective folded portions such that the loops define a series of channel forming seaming loops which receive the pintle means.

* * * * *